United States Patent [19]

Spano

[11] Patent Number: 4,730,761

[45] Date of Patent: Mar. 15, 1988

[54] CUTTING FLEXIBLE FORMED PRODUCTS FROM FOAM RETAINING SHEET

[75] Inventor: John D. Spano, Bordentown County, N.J.

[73] Assignee: Personal Products Company, Milltown, N.J.

[21] Appl. No.: 897,463

[22] Filed: Aug. 15, 1986

[51] Int. Cl.[4] ..... B26F 3/00; B26D 9/00

[52] U.S. Cl. ..... 225/2; 53/559; 83/103; 83/374; 83/451; 225/96; 225/97; 225/103

[58] Field of Search ..... 225/2, 96, 103, 97; 83/103, 374, 451; 53/559

[56] References Cited

U.S. PATENT DOCUMENTS 3,088,353 5/1963 Hanington ..... 83/103 X
3,477,322 11/1969 Gerber et al. ..... 83/451 X
4,108,343 8/1978 Vossen ..... 225/97 X
4,233,801 11/1980 Watt ..... 53/559 X

*Primary Examiner*—Frank T. Yost

[57] ABSTRACT

A method for cutting flexible formed shell product from a flexible plastic foam sheet. In the method, a foam shell formed in the sheet is drawn into and positioned in a die unit lower cavity and the die assembly is clamped together. A cutting die unit having dual curved serrated knife elements then descends and severs the formed shell from the sheet at all locations except for two short segments located at opposite ends of the formed shell. Then as a separate step, the partly severed formed shell is punched out from the flexible foam sheet, so as to provide multiple formed products. The products are usually formed as multiple units oriented in an end-to-end relationship in the foam sheet and which are simultaneously severed from the sheet. Cutting die apparatus adapted for cutting the formed products from the foam sheet is also disclosed.

11 Claims, 7 Drawing Figures

50
52
56c
56b
53
53
59
56
57
56a
58
55
54
58
55

CUTTING FLEXIBLE FORMED PRODUCTS FROM FOAM RETAINING SHEET

BACKGROUND OF INVENTION

This invention pertains to cutting flexible foam shell products from a retaining sheet. It pertains particularly to a method and apparatus for rapidly die cutting flexible formed products made from an ethylene-containing foam material and covered by a facing sheet sealed onto the formed foam product, then removing the formed product from the foam retaining sheet.

Die cutting or punching relatively rigid sheet materials such as metals, paper or plastics from a surrounding sheet is generally well known, such as die punching flat shaped pieces from metal sheets or from relatively stiff plastic sheets or strips. However, rapidly die cutting and punching out formed parts or products from flexible plastic materials such as ethylene-containing foams which are easily extrudable is much more difficult to accomplish, because the material elongates easily particularly when the material being cut has a non-planar shape. Such difficulties with rapidly die cutting and punching out non-planar shapes from flexible easily extrudable foam materials have been unexpectedly overcome by the method and apparatus of the present invention.

SUMMARY OF INVENTION

This invention provides a method for cutting flexible formed foam shell products from a flexible ethylene-containing foam sheet by die cutting and then punching out the products from the retaining sheet. The formed products being cut and removed from the flexible foam sheet preferably have a non-planar upper surface having an offset from a reference plane of at least about 0.5 inch and preferably an 0.75–2.0 inch offset. The flexible formed product being cut may be provided as two or more layers, including a lower layer consisting of a closed-cell ethylene-containing flexible foam material having thickness of 0.030–0.250 inch, and an upper facing layer consisting of a porous sheet material having thickness of 0.001–0.020 inches bonded onto the foam layer. The foam sheet is preferably an ethylene-containing polymer foam material identified as Volara Type A, which is a crosslinked polyethylene foam manufactured and sold by Voltek, Inc., Lawrence, Mass. The expression "ethylene-containing polymer foam" used herein includes polyethylene homopolymer and ethylene-containing copolymers, preferably containing a major portion, by weight, of ethylene. It is preferred that the polymer present be crosslinked. Preferred comonomers, for preparing the polymers, include vinyl acetate, acrylic and methylacrylic acids and esters, such as ethyl acrylate. Blends of such polymers can also be used. The porous facing sheet is a liquid permeable generally hydrophobic fabric or film. Typical facing sheets include non-woven polyester, non-woven polypropylene, perforated films such as polyethylene film and the like. The facing sheet is preferably a non-woven fibrous web composed principally of polyester fibers.

During the formed product cut-out step, the product is first positioned within a die lower cavity of a die assembly, and then the product flange area to be cut is clamped between mating lower and upper units of the die assembly. After such clamping of the product, a knife having a serrated lower cutting edge and shaped to match the product shape descends against the flexible foam sheet to successively pierce and sever the foam material adjacent the product perimeter. The shaped product being cut out is preferably severed along its sides and ends except for at least one narrow connecting link remaining at each end of the product for retaining it to the surrounding foam sheet. Next, the substantially cut out product is punched out from the foam retaining sheet in a separate punching step for breaking the connecting link(s) at each end to provide individual flexible foam products.

More specifically, the present invention provides a method for cutting flexible formed foam products from a flexible foam retaining sheet, which includes the steps of providing at least one formed foam shell integrally attached to the foam sheet and preferably having a formed fibrous facing sheet bonded thereto, and positioning the formed shell within a lower cavity of a cutting die assembly and clamping the formed shell into the cutting die assembly. The die units are moved together to clamp the foam sheet and attached formed shell in the die assembly, after which the formed shell is cut from the plastic foam sheet at all points along the shell edge except for at least one connecting link located at opposite ends of the formed shell, which links serve to loosely retain the shell to the sheet; and then breaking the connecting links and removing the formed shell product from the foam sheet.

In the process, the formed shell is drawn into the positioning cavity of the lower die unit by vacuum pressure prior to clamping the shell in the mating die assembly. The foam sheet cutting step is performed with dual cutting knives, each knife having a serrated cutting edge shaped to conform to the shape of one side of the product. For each knife the serrated cutting edge preferably has a single bevel angled away from the formed product, so as to provide a clean cut adjacent the product. After cutting, the formed foam shell is removed from the foam sheet by punching out the partially severed shell and breaking the links connecting it to the surrounding sheet. Usually two formed shells are provided oriented in an end-to-end relationship in the sheet, and each shell and any facing sheet attached thereto are cut simultaneously from the foam sheet. Preferably 4–10 formed shell products are die cut simultaneously from the surrounding foam sheet.

The present invention also provides an apparatus for cutting the flexible formed shell products from a sheet to which they are integrally attached. The apparatus includes a lower die unit having at least two adjacent cavities formed therein and containing a plurality of flow passages for partially evacuating the cavity, and an upper die unit having an edge clamping flange for clamping against the upper surface of the lower die unit. At least one cutting blade is incorporated into the upper die unit. Actuation means are provided for moving the lower and upper die units together so as to clamp the flexible foam sheet between the cutting die units and then cut the formed shell product from the retaining sheet.

It is an advantage of this invention that a flexible extrudable ethylene-containing foam sheet retaining a formed shell product having a non-planar upper surface can be rapidly cut from the retaining sheet cleanly and quickly by using shaped serrated cutting knives having serrated tooth edges, even when multiple layers of such materials are provided. The cutting step provides a clean smooth cut along the perimeter of the formed product at cycle times of 10–30 cycles per second.

DESCRIPTION OF INVENTION

Figure 1:
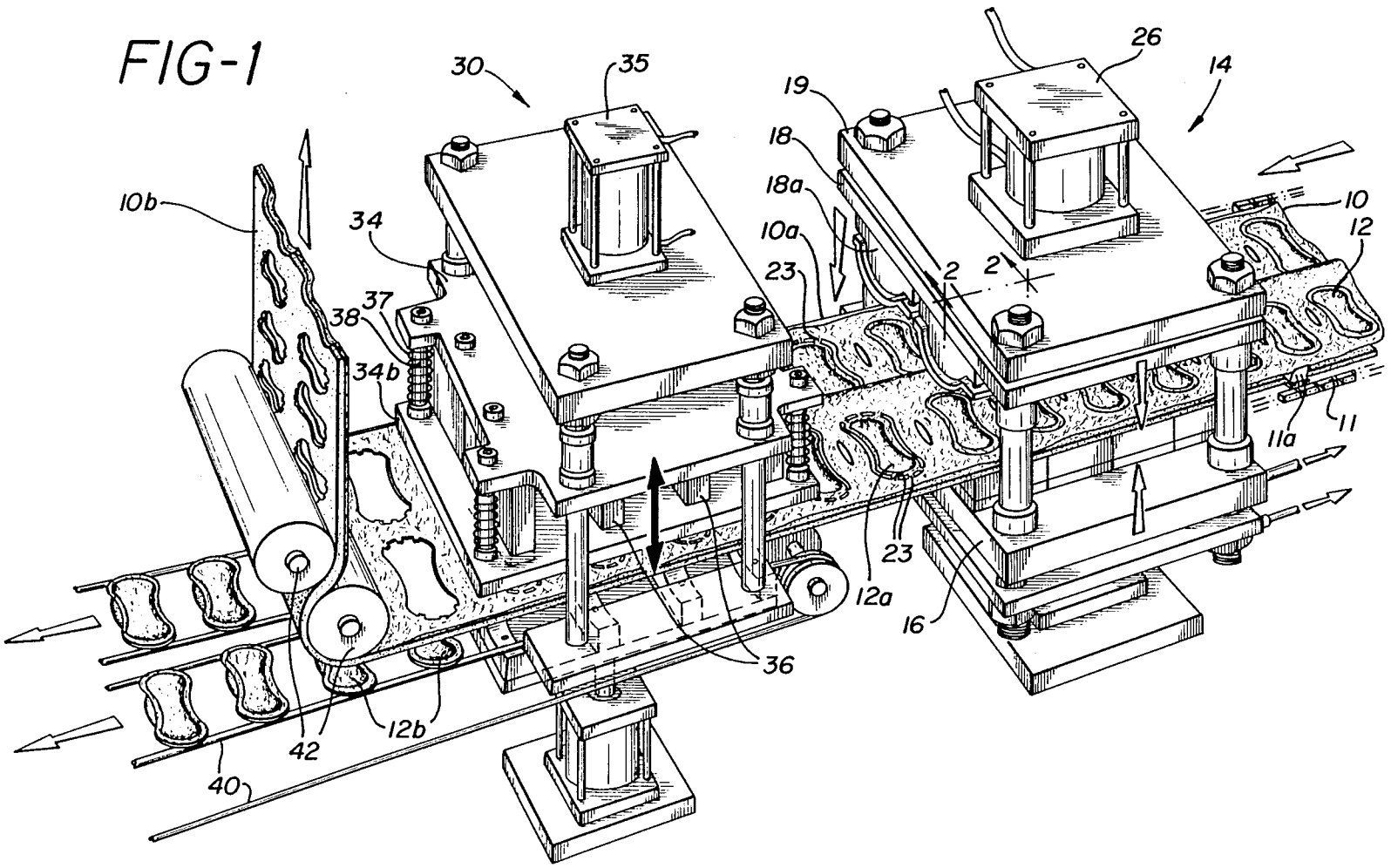
FIG. 1 is a perspective view showing method steps and apparatus for rapidly die cutting formed shell products from a sheet containing same in accordance with the present invention.

As is generally shown by FIG. 1, an elongated flexible ethylene-containing foam sheet is provided at 10 attached along its edges to conveyor chain 11 by clips 11a. The sheet 10 contains a plurality of shell-shaped products 12 which are integrally formed in and attached to the sheet. The foam sheet 10 as shown has a plurality of symmetrical curved shaped shells oriented parallel to each other and also preferably provided in end-to-end arrangement. Alternatively, the foam strip 10 may be made narrower or wider so as to provide one or more parallel products oriented in and end-to-end relationship. The product(s) 12 retained in sheet 10 may each have a fibrous absorbent web piece 11 included therein, which is preferably covered by a flexible fibrous sheet 13 bonded to the sheet 10 and to the product 12 as seen in FIG. 2A.

The foam sheet 10 including multiple parallel formed shell products 12 is moved forward intermittently by conveyor chain 11 to a cutting die assembly 14, which includes a lower die unit 16 and an upper die unit 18. After the sheet 10 containing the integral formed shells 12 has been indexed forward so that the shells are in vertical alignment with the lower and upper units of the die assembly 14, the lower die unit 16 is moved upward so as to receive and support the formed shells 12. Then the upper die unit 18 which includes an outer frame portion 18a is moved downward to mate with the lower die unit 16 and clamp the foam sheet 10 and fibrous facing sheet 13 firmly between the two die units. Next, top portion 19 of the upper die unit 18 containing dual curved cutting knives 20 is moved downward to contact and sever the foam sheet 10 along a curved line 21 closely adjacent to the formed shells 12, except for at least one short link 23 located at each end of the product 12 where it remains attached to the sheet 10.

Following such partial severing of the formed shell products 12 from sheet 10, the sheet at 10a is moved forward intermittently to product punch out assembly 30. Here the partially severed shell-shaped products 12a, still loosely retained by sheet 10a, are contacted from below by lower support frame 32 having openings 33 therein. Next upper punch unit 34 descends by action of piston 35 and clamps the sheet 10a between the support 32 and lower clamp plate 34b. Then upper plate 34a having punches 36 attached to its lower side descends further by action of the piston 35 to compress springs 37 surrounding guide rod 38 and punch out the products 12a from the surrounding foam sheet 10a. Then piston 35 withdraws upwardly the upper punch unit 34 including punches 36. The resulting individual products 12b are guided downwardly onto a conveyor 40 and are then carried away for further processing, such as to inspection and packaging steps (not shown). The remaining scrap sheet 10b is withdrawn upward by rollers 42 for disposal.

Figure 2:
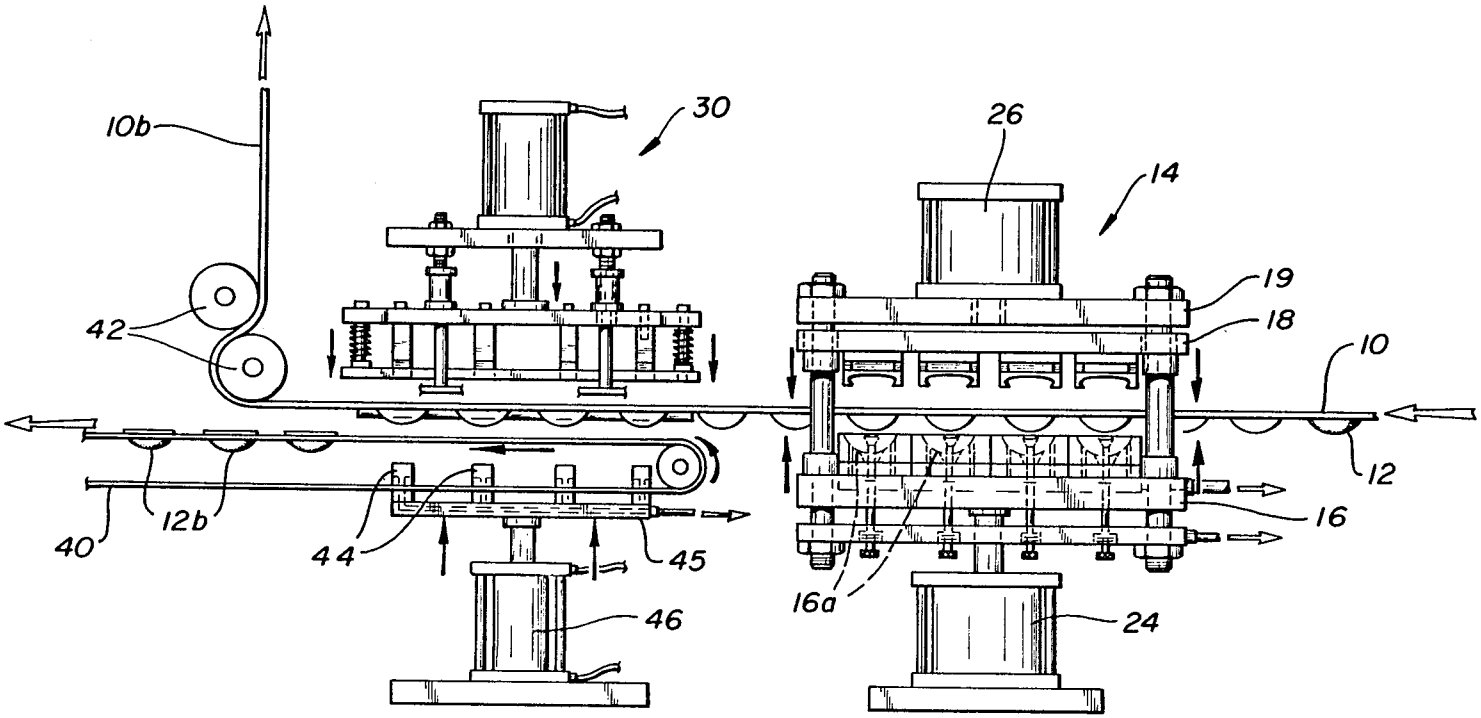
FIG. 2 shows a schematic elevation view of the die cutting and subsequent punch out method steps according to the invention, including some additional details of the separate die cutting and punch out steps and apparatus.
Figure 2A:
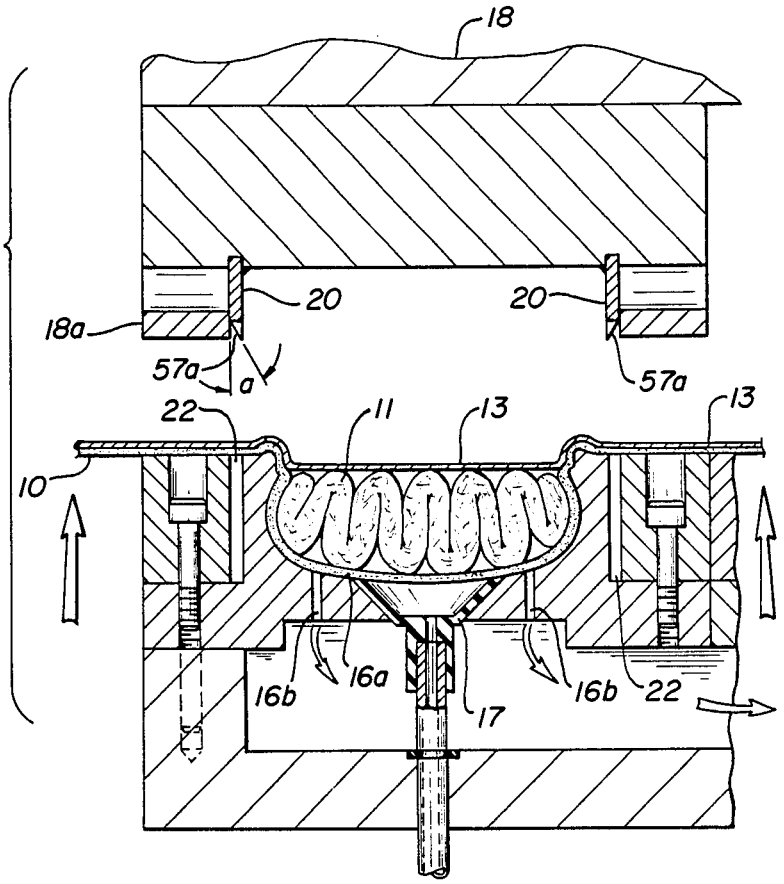
FIG. 2A shows a cross-sectional view of the die cutting step taken at line 2—2 of FIG. 1, before the upper die clamping frame and knives contact the formed shell located in the lower die unit.

The invention is additionally shown by the FIG. 2 schematic drawing, showing a sectional elevation view of the die cutting step 14 and punch out steps 30 for the product. The flexible plastic foam sheet at 10, containing a plurality of shell-shaped products 12 integrally formed and attached to the sheet, is moved forward intermittently to the cutting die assembly 14, which includes lower die unit 16 and mating upper die unit 18. After the sheet 10 containing integral shell 12 has been indexed forward so that four shells are each in vertical alignment with the cavities 16a in the lower die unit 16, the lower die unit is moved upward by piston 24 so as to receive and support the four formed shells 12 within the die cavities 16a, as is shown in greater detail by FIG. 2A. The piston 24 includes a stabilizing mechanism (not shown) which positions the lower die unit rigidly so as to withstand the downward cutting force from the upper die unit 18. Receiving the formed shell 12 into die cavities 16a is facilitated by vacuum pressure applied at passages 16b which communicate with cavity 16a. Also vertically movable suction cup 17 contained in lower die unit 16 is extended upwardly and contacts the lower surface of shell product 12 and facilitates drawing each shell 12 downwardly into cavity 16a of the lower die unit 16. Then the upper die unit 18 is moved downward by action of piston 26 to mate with the lower die unit 16 and clamp the sheets 10 and 13 therebetween. Next, the top portion 19 of upper die unit 18 containing dual cutting knives 20 is moved downward, so that the knives each enter mating groove 22 and sever the foam sheet 10 along a curved line 21 closely adjacent to the formed shell 12, as is shown in greater detail in FIG. 2B.

Figure 2B:
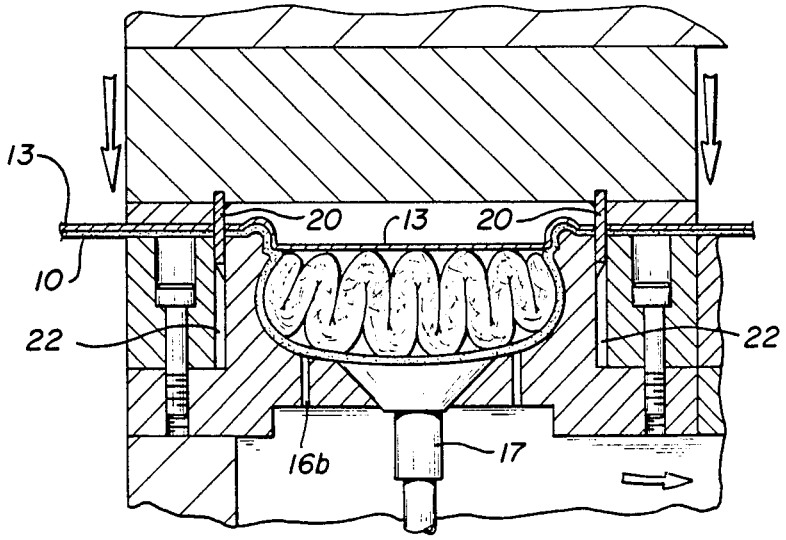
FIG. 2B shows another cross-sectional view of the die cutting step taken at line 2—2 of FIG. 1, after the upper die and cutting knives have locally severed the sheet adjacent the formed shell product.
Figure 2C:
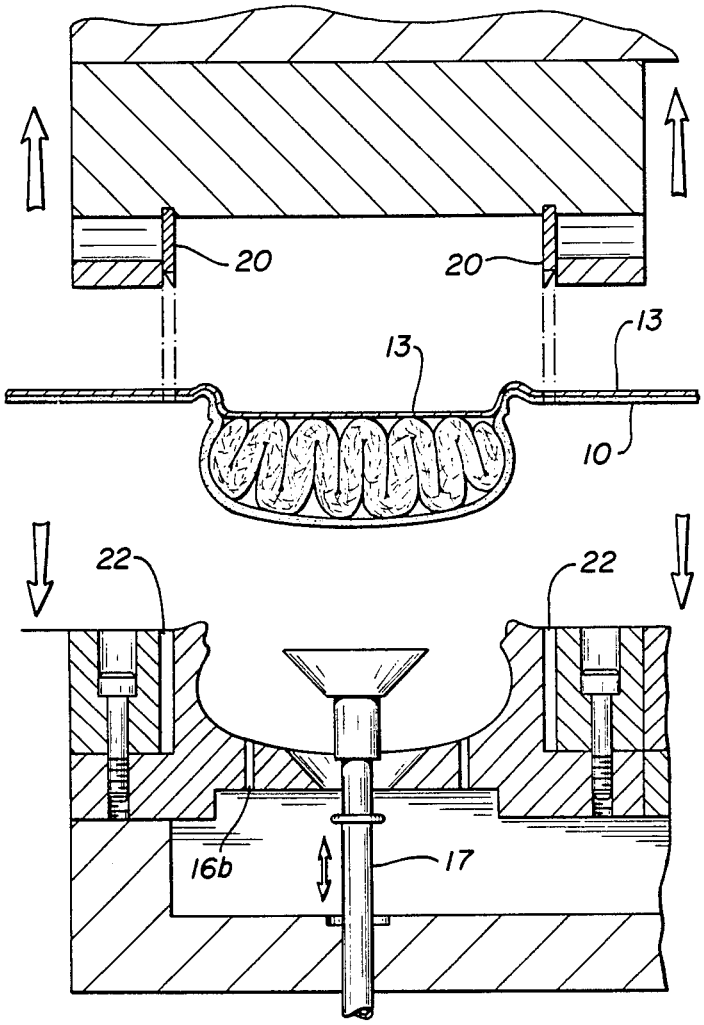
FIG. 2C shows another cross-sectional view taken at line 2—2 of FIG. 1, after the formed shell product has been partially severed from its retaining sheet and removed from the lower die unit.

Following the severing of product 12 from foam sheet 10, except for a connecting link 23 at each end as explained hereinbelow, the upper die unit 18 is moved upwardly and lower die unit 16 is withdrawn downwardly, while cup 17 remains in place to eject the formed shell 12 out of die cavity 16a, as shown in greater detail by FIG. 2C.

Figure 3:
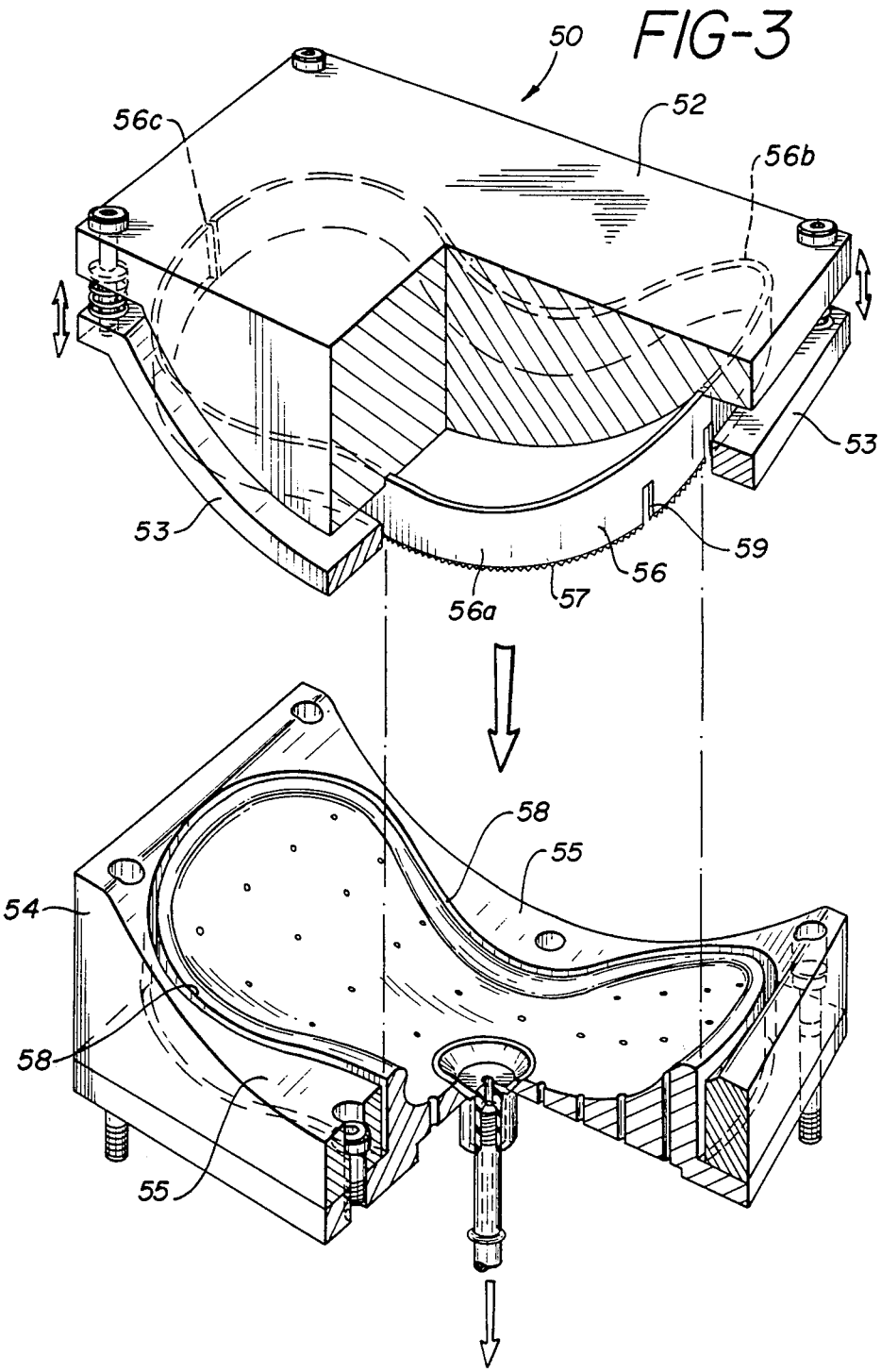
FIG. 3 shows a perspective and partial sectional view of a single cutting die set of the die assembly, and shows location of dual cutting knives relative to the lower die unit and edges of the product.

Additional important details of a single cutting die set 50 used in the cutting die assembly 14 are shown by FIG. 3. It is seen that the die unit upper portion 52 is provided with an outer clamping flange 53 extending along each side of die portion 52 and is shaped to mate with outer portion 55 of lower die portion 54. Also, located inwardly from flange 53, there is provided a curved cutting knife 56 having multiple serrated teeth 57 on the cutting edge, the knife being curved as needed to match the shape of product 12. Preferably two similar shaped cutting knives 56a and 56b are provided, which are separated by a narrow gap at 56c therebetween. The cutting edge of the knife 56 may be curved downwardly at the central portion and the teeth 57 are beveled on only the outer side 57a, as shown by FIGS. 2A-2C.

The lower die portion 54 contains a narrow shaped groove 58 sized for receiving the cutting knife 56, which is curved to have a symmetrical shape corresponding to that of one side of the product 12, as is shown in FIG. 3. The knives, which may each have a notch 59 provided near each end, fit into groove 58 provided in the lower die unit 54 adjacent the cavity 16a. Total lateral clearance between the knives 56 and groove 58 is 0.020–0.040 inch. The knife 56 protrudes into groove 58 by a distance equal to at least twice the thickness of the foam sheet 10, and preferably protrudes by 3–5 times the foam sheet thickness. The knife 56 is provided on its cutting edge with a plurality of teeth 57 each spaced apart by less than about 0.50 inch and preferably having teeth spacing between about 0.06 and 0.30 inches. The teeth each have a single level at an angle "a" of 45°–60° with the horizontal plane and located on the side of knife 52 away from product shell 12, so as to provide a clean cut through the sheet on the side adjacent the shell, as shown by FIG. 2B.

Figure 4:
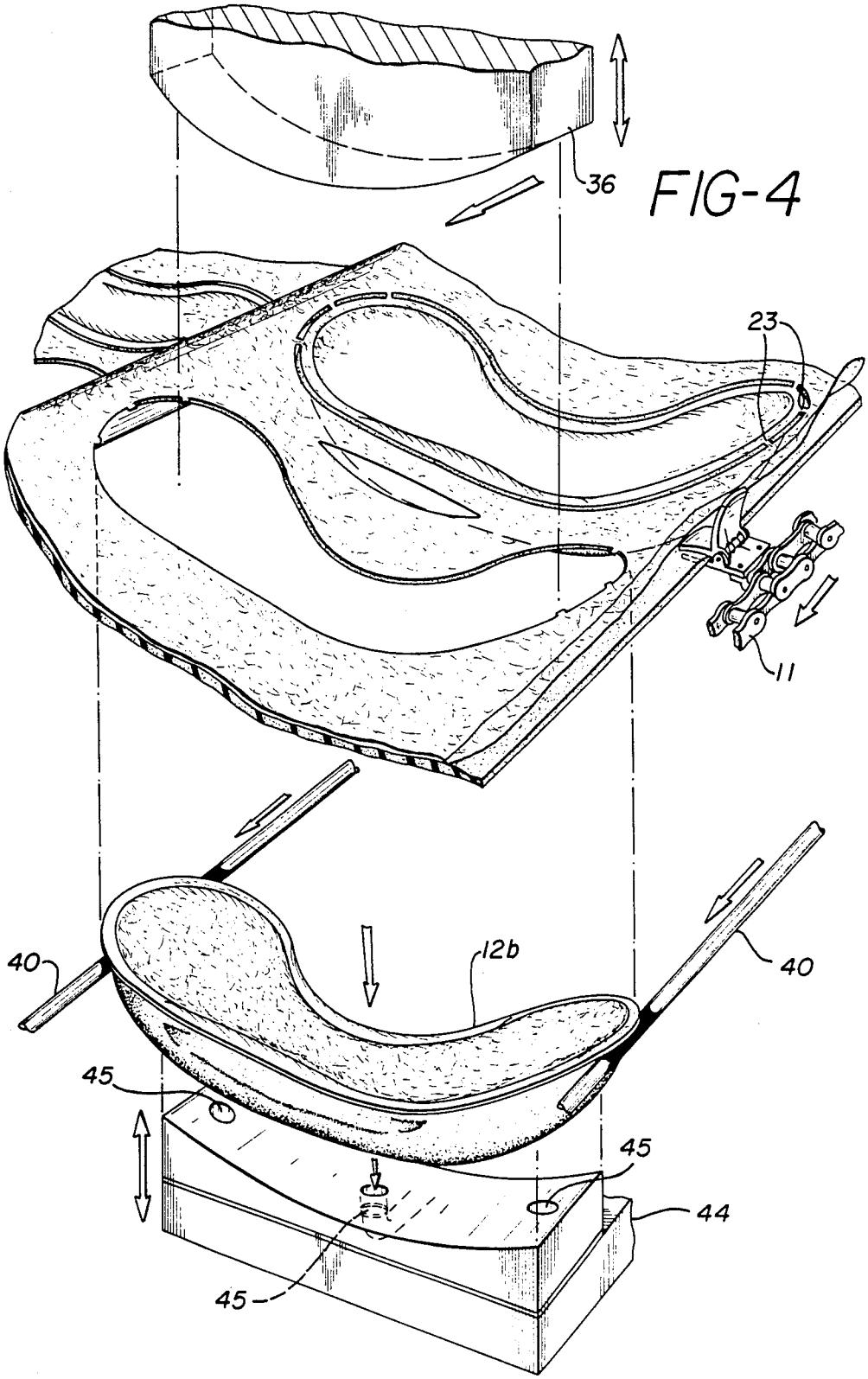
FIG. 4 shows a perspective view of the punch-out step and punch assembly before and after the die cut shell product is punched out from its retaining sheet.

In the method of the invention, the lower die unit 16 serves to receive and precisely position the formed product(s) 12 relative to the location of the cutting knife or knives 56, before the product(s) is severed from the foam sheet 10. To provide adequate positioning of the product, the lower die unit 16 is provided with at least two cavities 16a into which a shaped product 12 is rapidly drawn, preferably being drawn within the cavity by aid of vacuum pressure provided through suction cup 17 and multiple flow passages 16b provided within the lower die body 16. After the lower die unit 16 has been moved upward to receive and position the shaped product 12, the upper die unit 18 descends and clamps the sheet firmly between the mating die units. Then the cutting head portion of the upper die unit carrying the cutting knives 56 is moved downwardly and the knives enter the slot 58 and cut through the foam sheet 10 and facing sheet 13 adjacent the product 12. At least one narrow segment 23 of sheet 10 is left uncut at opposite ends of the partially cut out product 12a to provide a connecting link for temporarily retaining the product to the sheet. Preferably two links 23a and 23b are provided equally-spaced on each side of the product center line, as shown by FIGS. 1 and 4, to additionally stabilize the product 12 relative to the sheet 10a. *The resulting foam sheet at 10a* carrying the partially cut out products 12 is next moved intermittently forward to a product punch out step effected by punch assembly 30. As generally shown by FIGS. 1 and 2, the foam sheet at 10a is positioned over a lower die punch out frame 32 having openings 33 therein, and the formed shells 12 are positioned within the openings usually by vertical upward movement of the frame. Next, an upper punch unit provided with centrally located punches 36 is moved downwardly against the products 12 by piston 35 to clamp the product and then rupture the links 23 at each end of the product and thereby remove the products from the surrounding sheet 10a. The orientation of the punches 36 relative to the shells 12 is additionally shown in perspective by FIG. 4. It is seen that the individual products 12b are guided downward onto conveyor belt 40 by vertically movable guides 44 operated by pneumatic actuator piston 46. The guide 44 contains flow passages 45 through which a vacuum pressure is provided to facilitate the controlled downward movement of the products 12b onto belt 40 as shown by FIGS. 2 and 5, and are carried away to inspection and packaging steps (not shown). The remaining scrap strip 10b is removed overhead via roller 42 for suitable disposal, as was shown by FIG. 2.

This invention will be further described by reference to the following examples of operations for cutting a formed flexible foam shell from a retaining sheet, which should not be construed as limiting in scope.

EXAMPLE 1

An ethylene-containing foam sheet containing multiple formed shell products aligned in two parallel rows. The foam sheet is 0.125 inches thick and 16 inches wide, and the shells are each 3 inches wide and 7.5 inches long, with the shells being covered by a fibrous polyester facing sheet heat bonded onto the foam sheet. The foam sheet integrally containing the formed shells is fed to a cutting die assembly containing eight matched cutting die units, after which the sheet is intermittently indexed forward by a distance equal to the width of four shells.

The cutting dies are closed to first clamp the foam sheet and shell product, and then to sever the shell from the foam sheet. Important characteristics of the materials and cutting die assembly are as follows:

| Cutting blade material | Spring steel |
|---|---|
| Cutting blade width, in. | 0.020 |
| Blade teeth spacing, in. | 0.10 |
| Foam sheet thickness, in. | 0.125 |
| Facing sheet thickness, in. | 0.010 |
| Die groove width, inc. | 0.050 |

Following cut out of the foam shell products, the sheet is indexed forward to a punch out step in which the individual products are severed from the foam sheet and are guided downwardly onto a moving belt which continuously removes the products.

We claim:

1. A method for cutting a flexible formed shell product from a flexible plastic foam sheet, comprising:
   (a) providing at least one formed foam shell integrally attached to a foam sheet, and positioning the formed shell within a cavity of a cutting die assembly having spaced die units;
   (b) clamping said formed shell into the cutting die assembly, then moving the die units together and clamping the foam sheet and attached formed shell in the die assembly;
   (c) cutting the formed shell from the plastic foam sheet at all points along the shell edge except for at least one link located at opposite ends of the formed shell, which links serve to loosely retain the shell to the sheet; and then
   (d) breaking the connecting links and removing the formed shell product from the foam sheet.

2. The method of claim 1, wherein the formed shell is drawn into the positioning cavity of a lower die unit of the die assembly by vacuum pressure prior to clamping the sheet and shell in the die assembly.

3. The method of claim 2, wherein the shell cutting step is made with dual cutting knives each shaped to conform to one side of the shell, which knives descend simultaneously to intersect the lower die unit, after which the partially severed shell is ejected from the lower die cavity.

4. The method of claim 1, wherein the shell cutting step is performed with dual curved knives, each knife having a serrated cutting edge shaped to conform to one side of the product, which knife enters a mating groove provided in the lower die unit.

5. The method of claim 4, wherein each knife serrated cutting edge has a single bevel angle oriented away from the formed product.

6. The method of claim 1, wherein the products have non-planar upper surface having an offset of 0.5–2 inches.

7. The method of claim 1, wherein the formed shell includes a facing sheet bonded onto the shell and the cutting occurs along a curved line located outside the bonded joint between the facing sheet and the formed shell.

8. The method of claim 1, wherein 4–10 formed products integrally attached to said sheet are cut simultaneously from the sheet.

9. The method of claim 1, wherein the formed shell is removed by punching the die cut foam shell to break the connecting links between the formed shell and the foam sheet.

10. The method of claim 1, including guiding the formed shells downwardly onto a conveyor by vertically movable guides.

11. A method for cutting a flexible formed shell from a flexible foam sheet, comprising:

(a) providing 2–8 formed shells integrally attached to a foam sheet, said formed shells having a flexible fibrous facing sheet bonded thereto, and positioning each formed shell within a lower cavity of a matched cutting die assembly having spaced die units by vacuum pressure;

(b) clamping said formed shells and facing sheet into a cutting die assembly; then moving the die units vertically together and clamping the foam sheet and each formed shell in the die assembly;

(c) die cutting each formed shell from the plastic foam sheet along the shell edge by dual cutting knives, said cutting being done at all points except for two links located at opposite ends of each formed shell, which links serve to loosely retain the shell to the sheet, and then (d) breaking the retaining links by die punching and removing the formed shells from the foam sheet.

* * * * *